US007651111B2

(12) United States Patent
Butler

(10) Patent No.: US 7,651,111 B2
(45) Date of Patent: Jan. 26, 2010

(54) RETRACTABLE FIXTURE FOR USE WITH A WHEELCHAIR

(76) Inventor: Timothy Nathaniel Butler, 5900 Blanca Ct., Golden, CO (US) 80403

( * ) Notice: Subject to any disclaimer, the term of this patent is extended or adjusted under 35 U.S.C. 154(b) by 318 days.

(21) Appl. No.: 11/842,551

(22) Filed: Aug. 21, 2007

(65) Prior Publication Data

US 2009/0051137 A1 Feb. 26, 2009

(51) Int. Cl.
*A61G 5/10* (2006.01)

(52) U.S. Cl. ..... 280/304.1

(58) Field of Classification Search ..... 280/304.1; 297/DIG. 4, 154, 155, 166
See application file for complete search history.

(56) References Cited

U.S. PATENT DOCUMENTS 4,919,443 A 4/1990 Kehler
5,180,181 A 1/1993 Letechipia
5,299,824 A * 4/1994 Roberts et al. ..... 280/304.1
2008/0069678 A1 * 3/2008 Mahler et al. ..... 414/679

* cited by examiner

*Primary Examiner*—Glenn Dayoan
*Assistant Examiner*—Jacob Knutson
(74) *Attorney, Agent, or Firm*—Lathrop & Gage LLP

(57) ABSTRACT

Retractable fixtures for use with a wheelchair are disclosed herein. A retractable fixture of one embodiment includes a platform movable between a first position behind the wheelchair and a second position beside the wheelchair. A track having forward and rear ends is beside the wheelchair, and a carriage is configured to travel along the track. The carriage is rotatably coupled to the platform at a front pivot point, and an arm is rotatably coupled to the platform at a rear pivot point. The arm is rotatable about a fixed pivot point. When the platform moves from the first position to the second position, the carriage travels along the track toward the track front end, the platform rotates about the front pivot point in a first direction, and the arm rotates about the fixed pivot point in the first direction.

27 Claims, 7 Drawing Sheets

RETRACTABLE FIXTURE FOR USE WITH A WHEELCHAIR

BACKGROUND

Attachments for wheelchairs are disclosed herein. Wheelchairs provide mobility, and many wheelchairs are now motorized to increase that mobility. However, conventional wheelchairs and wheelchair attachments do not adequately provide users with access on demand to a fixture (e.g., a storage box, tray, planar surface, etc.) and do not allow the users to quickly and easily store the fixture when its use is no longer desired.

SUMMARY

A retractable fixture for use with a wheelchair could increase the independence of those using wheelchairs by allowing the users to conveniently access and store a fixture without help. Accordingly, retractable fixtures for use with a wheelchair are disclosed herein.

A retractable fixture of one embodiment includes an elongate track beside the wheelchair and a carriage configured to travel along the track. A platform is rotatably coupled to the carriage, and an arm is rotatably coupled to the platform. The arm is further coupled to an actuator that selectively rotates the arm in first and second directions. Rotation of the arm in the first direction rotates the platform outwardly from behind the wheelchair, and rotation of the platform outwardly from behind the wheelchair forces the carriage to travel along the track toward a forward end of the track and the platform to move beside the wheelchair. Rotation of the arm in the second direction rotates the platform inwardly from beside the wheelchair, and rotation of the platform inwardly from beside the wheelchair forces the carriage to travel along the track toward a rear end of the track and the platform to move behind the wheelchair.

In another embodiment, a retractable fixture for use with a wheelchair includes a track and an element for mounting the track beside the wheelchair. A carriage is configured to travel along the track, and a platform is rotatably coupled to the carriage at a front pivot point. An arm is rotatably coupled to the platform at a rear pivot point, and the arm has a fixed pivot point. The fixed pivot point, the rear pivot point, and the front pivot point are configured such that rotation of the arm in a first direction about the fixed pivot point rotates the platform outwardly from behind the wheelchair, and rotation of the platform outwardly from behind the wheelchair forces the carriage to travel along the track toward a forward end of the track and the platform to move beside the wheelchair.

In yet another embodiment, a retractable fixture for use with a wheelchair includes a platform movable between a first position behind the wheelchair and a second position beside the wheelchair. A track having a forward end and a rear end is beside the wheelchair, and a carriage is configured to travel along the track. The carriage is rotatably coupled to the platform at a front pivot point, and an arm is rotatably coupled to the platform at a rear pivot point. The arm is rotatable about a fixed pivot point. When the platform moves from the first position to the second position, the carriage travels along the track toward the track front end, the platform rotates about the front pivot point in a first direction, and the arm rotates about the fixed pivot point in the first direction. When the platform moves from the second position to the first position, the carriage travels along the track toward the track second end, the platform rotates about the front pivot point in a second direction, and the arm rotates about the fixed pivot point in the second direction.

DETAILED DESCRIPTION

Figure 1:
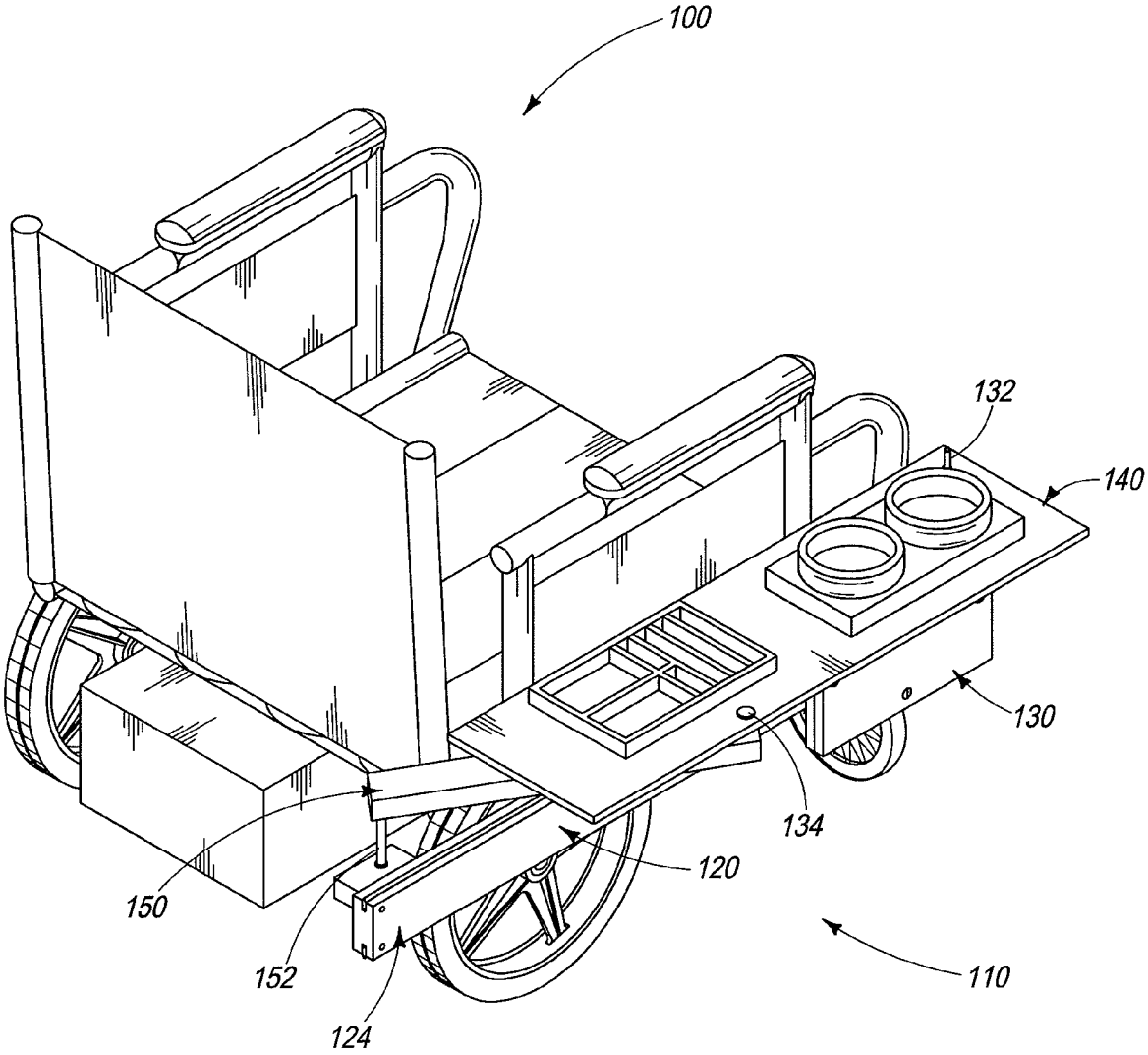
FIG. 1 is a perspective view of a wheelchair and a retractable fixture according to an embodiment.

FIG. 1 shows a wheelchair 100 and a retractable fixture 110. Retractable fixture 110 includes an elongate track 120, a carriage 130 configured to travel along track 120, a platform 140 rotatably coupled to carriage 130, and an arm 150 rotatably coupled to platform 140. Track 120 has a forward end 122 and a rear end 124 (FIG. 3), may be generally linear, and is positioned beside wheelchair 100. More particularly, track 120 may be permanently or removably mounted to wheelchair 100, such as by a bracket, a weld, a rivet, adhesive, and/or any other appropriate fastener.

Figure 3:
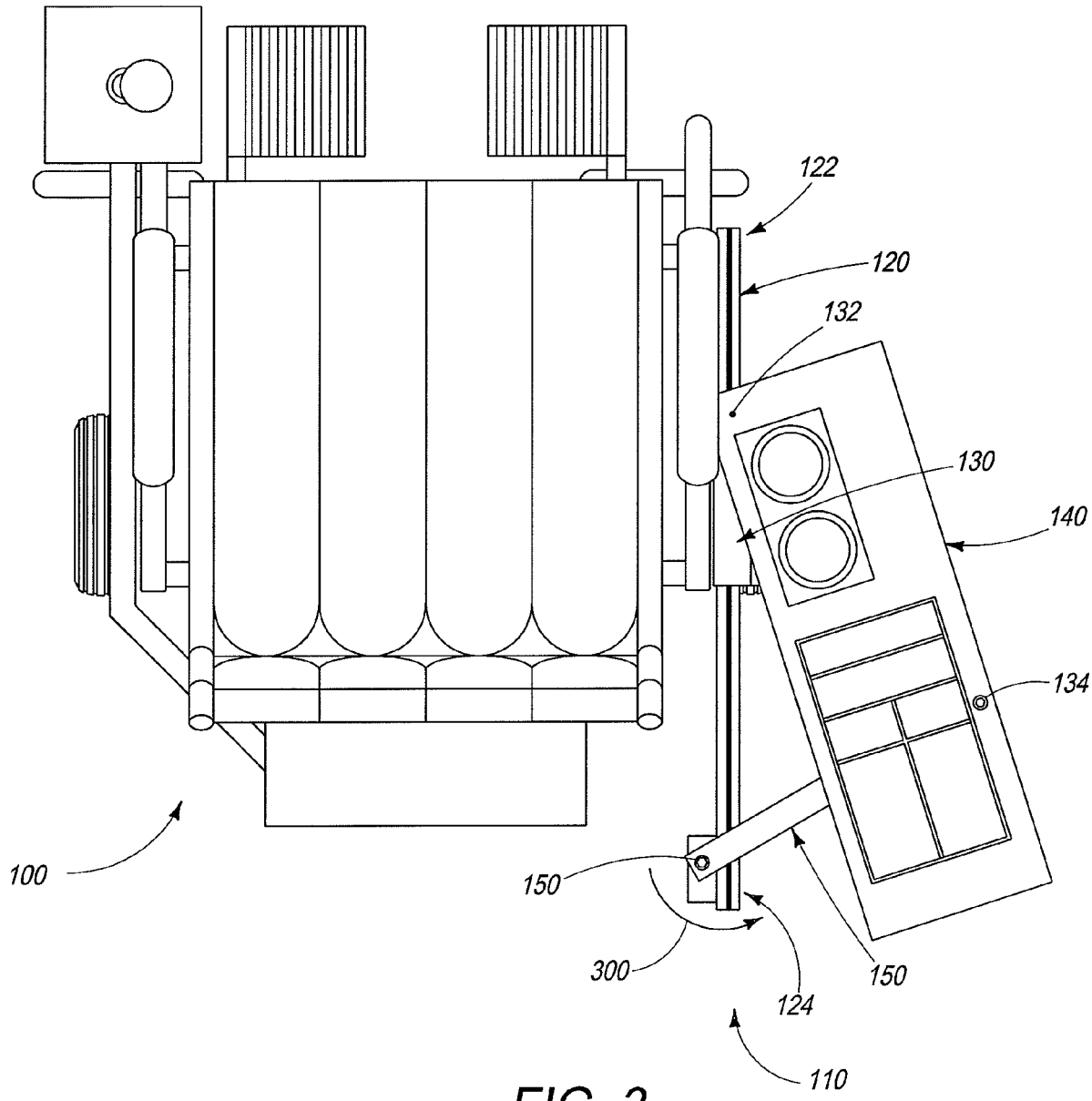
FIG. 3 is a top view of the wheelchair and retractable fixture of FIG. 1 with the platform moving between a position behind the wheelchair and a position beside the wheelchair.
Figure 4:
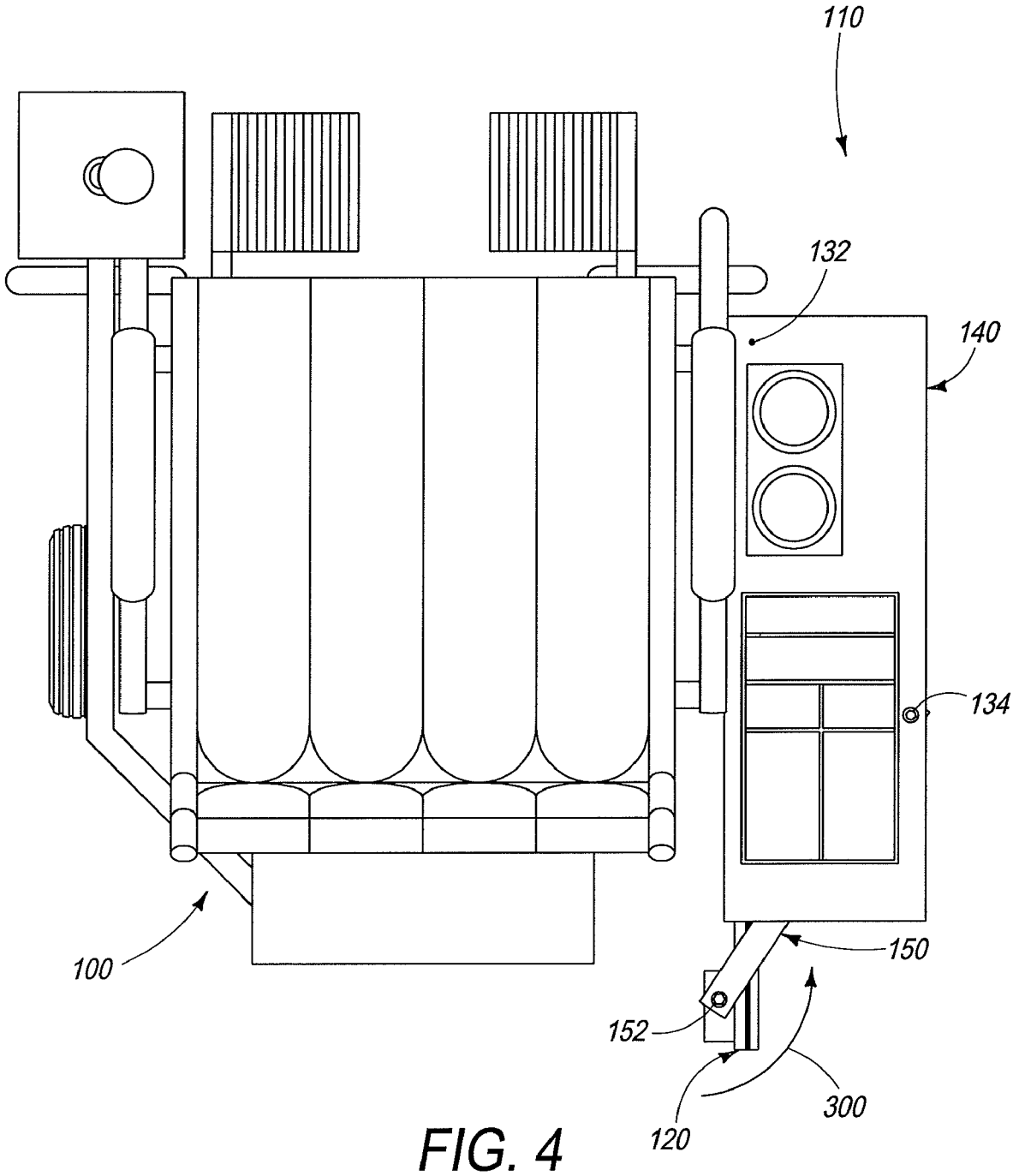
FIG. 4 is a top view of the wheelchair and retractable fixture of FIG. 1 with the platform located beside the wheelchair.

Platform 140 is rotatably coupled to carriage 130 at a front pivot point 132, arm 150 is rotatably coupled to platform 140 at a rear pivot point 134, and arm 150 is rotatable about a fixed pivot point 152. While FIGS. 3-5 show fixed pivot point 152 coupled to track 120, such coupling is not necessary. However, fixing the relationship between pivot point 152 and track 120 may ease installation and eliminate potential maintenance that could otherwise be required to locate pivot point 152 as desired relative to track 120.

Figure 2:
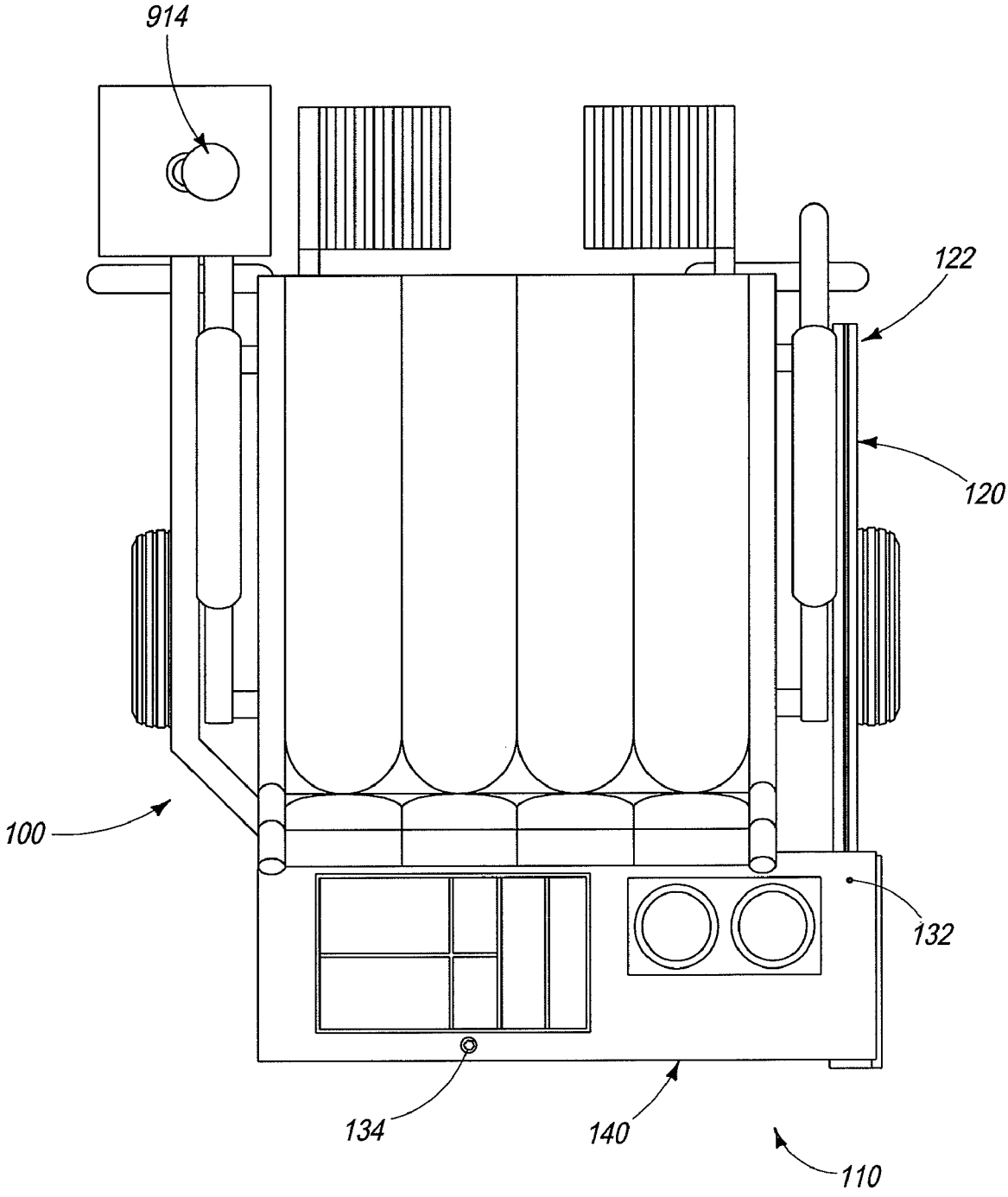
FIG. 2 is a top view of the wheelchair and retractable fixture of FIG. 1, with the platform located behind the wheelchair.

As shown in FIG. 2, platform 140 may also be located behind wheelchair 100 when not in use. When platform 140 is needed, rotation of arm 150 in a first direction (i.e., in accordance with arrow 300 in FIG. 3) rotates platform 140 outwardly (i.e., in accordance with arrow 300) from behind wheelchair 100, and rotation of platform 140 outwardly from behind wheelchair 100 can urge carriage 130 to travel along track 120 toward track forward end 122 and platform 140 to move beside wheelchair 100 (FIG. 4). Similarly, when platform 140 is located behind wheelchair 100 (FIG. 2), the movement of carriage 130 along track 120 toward track forward end 122 can urge platform 140 to rotate about front pivot point 132 in a first direction (i.e., in accordance with arrow 300 in FIG. 3) and arm 150 to rotate about fixed pivot point 152 in the same first direction, thereby moving platform 140 to a position beside wheelchair 100 (FIG. 4).

The arm 150 may, for example, be rotated by a motor and gearbox arrangement. A ninety degree gearbox or any other appropriate gearbox may be used. In such a configuration, a drive shaft of the gearbox may function as fixed pivot point 152. Whether force is imparted by rotating arm 150 or moving carriage 130 may be generally immaterial to the overall function of retractable fixture 110.

Once platform 140 is no longer desired beside wheelchair 100 (FIG. 4), platform 140 may be returned to the position behind wheelchair 100. For example, rotation of arm 150 in a second direction (i.e., opposite arrow 300 in FIG. 3) rotates platform 140 inwardly (i.e., opposite arrow 300) from beside wheelchair 100, and rotation of platform 140 inwardly from beside wheelchair 100 may urge carriage 130 to travel along track 120 toward track rear end 124 and platform 140 to move behind wheelchair 100 (FIG. 2). Similarly, when platform 140 is located beside wheelchair 100 (FIG. 4), the movement of carriage 130 along track 120 toward track second end 124 can urge platform 140 to rotate about front pivot point 132 in a second direction (i.e., opposite arrow 300 in FIG. 3) and arm 150 to rotate about fixed pivot point 152 in the second direction, moving platform 140 to a position behind wheelchair 100 (FIG. 2). Again, whether force is imparted by rotating arm 150 (e.g., by a motor and gearbox arrangement, manually, etc.) or moving carriage 130 may be generally immaterial to the overall function of retractable fixture 110.

Figure 5A:
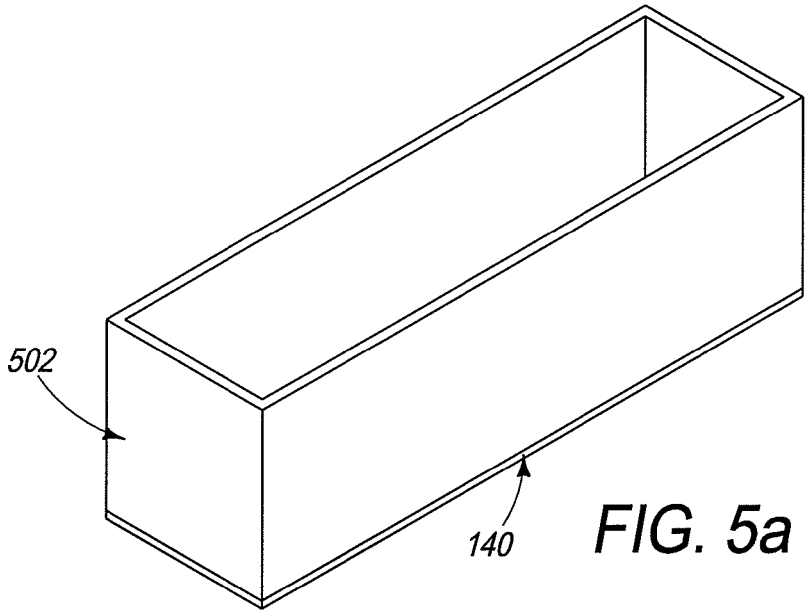
FIG. 5*a* is a perspective view of the platform of the retractable fixture of FIG. 1 according to an embodiment.
Figure 5B:
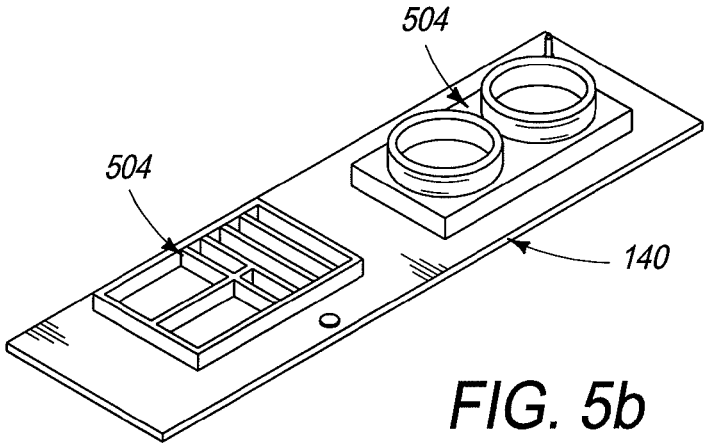
FIG. 5*b* is a perspective view of the platform of the retractable fixture of FIG. 1 according to another embodiment.
Figure 5C:
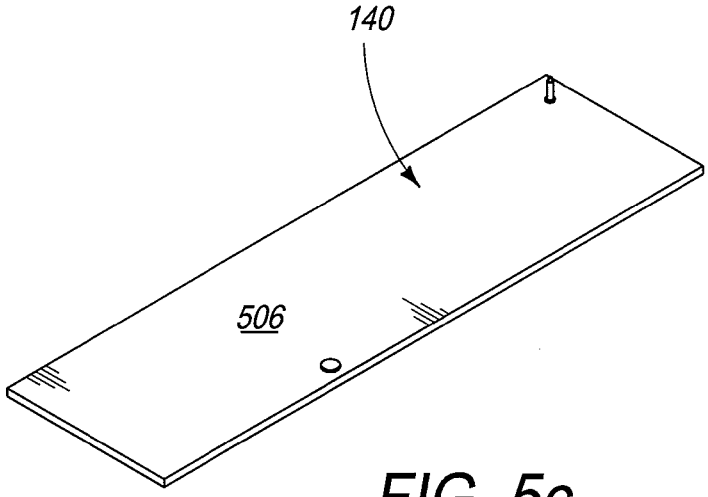
FIG. 5*c* is a perspective view of the platform of the retractable fixture of FIG. 1 according to yet another embodiment.

As shown in FIGS. 5*a*-5*c*, platform 140 may include, for example, a storage box 502, a compartmentalized tray 504, and/or a generally planar surface 506. Elements such as box 502, tray 504, and surface 506 may be removably coupled to platform 140, permanently coupled to platform 140, or of unitary construction with platform 140.

Figure 6:
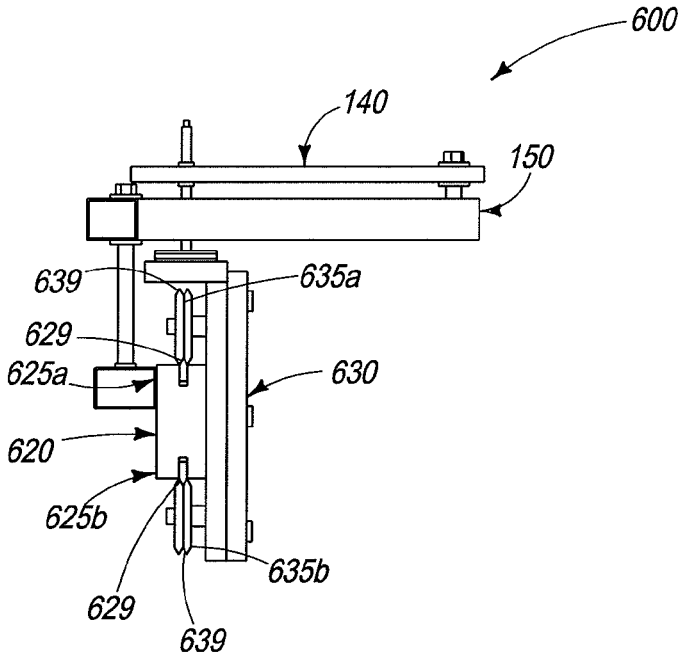
FIG. 6 is a rear view of a retractable fixture according to an embodiment.
Figure 7:
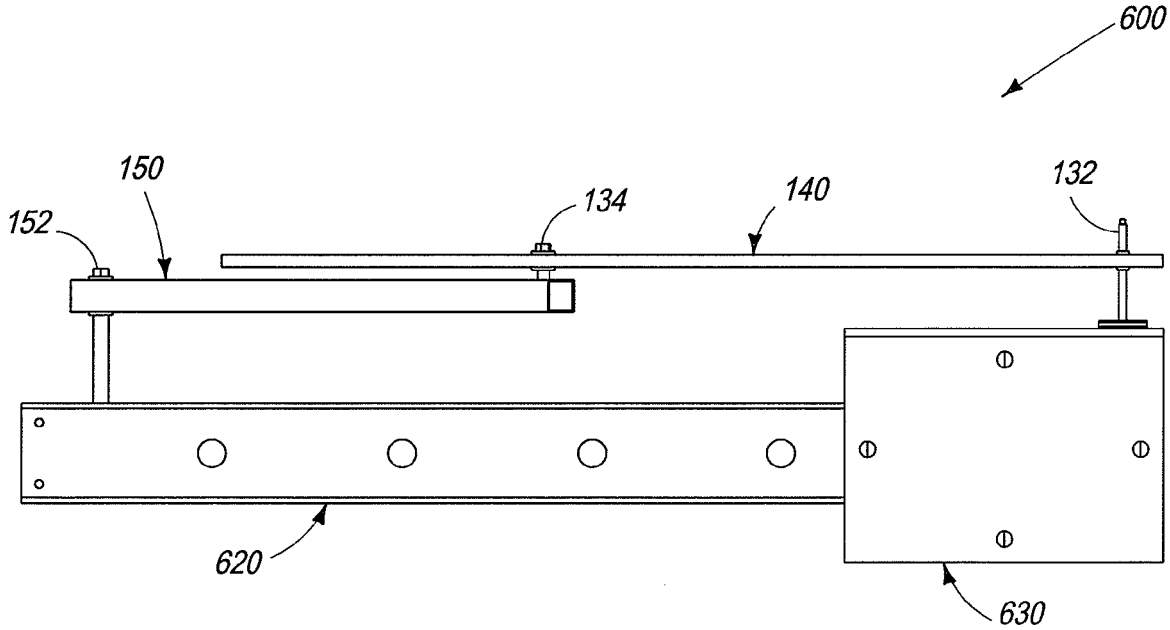
FIG. 7 is a side view of the retractable fixture of FIG. 6.

FIGS. 6 and 7 show an embodiment of a retractable fixture 600 that is generally similar to retractable fixture 110 described above in several of its main features, and distinct features from retractable fixture 600 may be utilized on or with retractable fixture 110. Instead of track 120 and carriage 130, fixture 600 includes a track 620 and a carriage 630. Carriage 630 has a plurality of upper wheels 635*a* that are complementary to an upper portion 625*a* of track 620 and a plurality of lower wheels 635*b* that are complementary to a lower portion 625*b* of track 620 so that the wheels 635*a*, 635*b* may rotate as carriage 630 travels along track 620. The upper and lower portions 625*a*, 625*b* of track 620 may respectively have protrusions 629 (FIG. 6), and wheels 635*a*, 635*b* may include grooves 639 complementary protrusions 629. The coupling of protrusions 629 with grooves 639 may aid in aligning carriage 630 to track 620.

Figure 8:
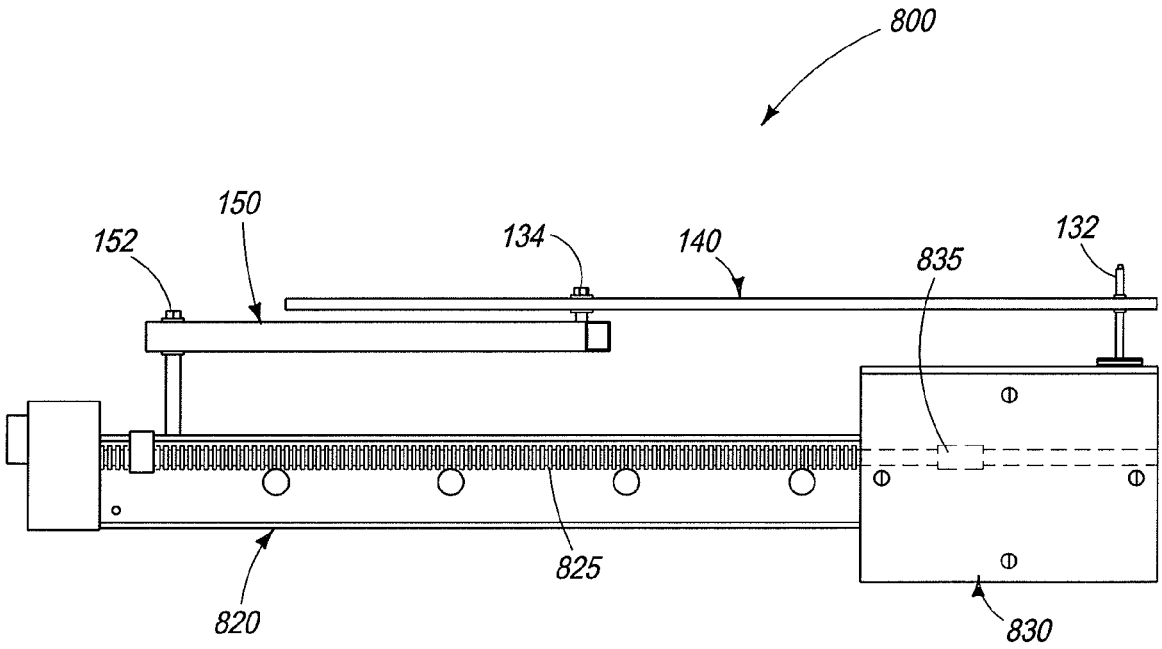
FIG. 8 is a side view of a retractable fixture according to an embodiment.

FIG. 8 shows an embodiment of a retractable fixture 800 that is also generally similar to retractable fixture 110 described above in its main features, and features from retractable fixture 800 may also be utilized on or with retractable fixture 110. Instead of track 120 and carriage 130, fixture 800 includes a track 820 and a carriage 830. Carriage 830 has a collar 835 that interacts with a screw drive 825 of track 820 so that carriage 830 travels only linearly along track 820.

Figure 9:
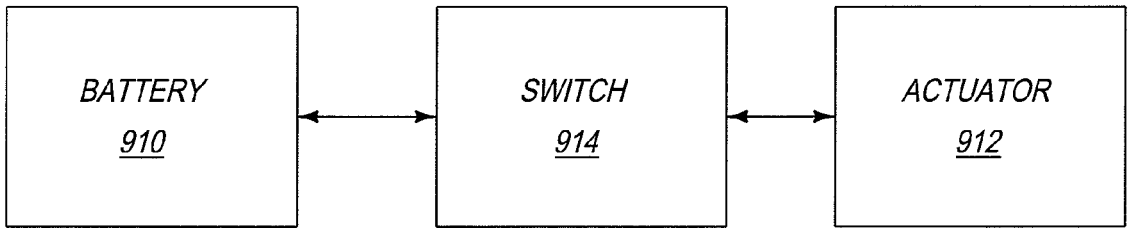
FIG. 9 is a schematic view of an electrical system for use with any of the retractable fixture embodiments disclosed herein.

FIG. 9 schematically shows an electrical system 900 which may be used for retractable fixture 110. A battery 910 is electrically coupled to an actuator 912 (e.g., a motor and gearbox arrangement as discussed above) and a switch 914. Battery 910 may be included with wheelchair 100 for motorized movement of wheelchair 100, or battery 910 may be separate from wheelchair 100. Actuator 912 may be coupled to arm 150, for example, and actuator 912 may rotate arm 150 in the first and second directions (i.e., in accordance with arrow 300 in FIG. 3 and opposite arrow 300, as noted above) upon input from switch 914. Switch 914 may be coupled to an arm of wheelchair 100, for example, as shown in FIG. 2. If retractable fixture 110 incorporates track 820 and carriage 830, actuator 912 may be coupled to screw drive 825 to move carriage 830 along track 820 upon input from switch 914.

Those skilled in the art appreciate that variations from the specified embodiments disclosed above are contemplated herein. The description should not be restricted to the above embodiments or the accompanying figures, but should be measured by the following claims. Terms such as "outwardly" and "inwardly" are used herein to denote one direction relative to another and are otherwise not limiting. The phrase "coupled to" is used herein to denote some degree of attachment and does not require direct interaction.

What is claimed is:

1. A retractable fixture for use with a wheelchair, comprising:
   an elongate track beside the wheelchair, the track having a forward end and a rear end;
   a carriage configured to travel along the track;
   a platform rotatably coupled to the carriage; and
   an arm rotatably coupled to the platform and coupled to an actuator;
   wherein the actuator selectively rotates the arm in first and second directions;
   wherein rotation of the arm in the first direction rotates the platform outwardly from behind the wheelchair, and rotation of the platform outwardly from behind the wheelchair forces the carriage to travel along the track toward the track forward end and the platform to move beside the wheelchair; and
   wherein rotation of the arm in the second direction rotates the platform inwardly from beside the wheelchair, and rotation of the platform inwardly from beside the wheelchair forces the carriage to travel along the track toward the track rear end and the platform to move behind the wheelchair.

2. The retractable fixture of claim 1, further comprising a storage box atop the platform.

3. The retractable fixture of claim 1, wherein:
   the wheelchair includes a battery; and
   the actuator is electrically coupled to the battery.

4. The retractable fixture of claim 1, further comprising a switch in communication with the actuator for causing the actuator to rotate the arm in the first and second directions, the switch being coupled to an arm of the wheelchair.

5. The retractable fixture of claim 1, wherein:
   the carriage includes a wheel complementary to the track; and
   the wheel rotates as the carriage travels along the track.

6. The retractable fixture of claim 1, wherein:
   the carriage includes a plurality of upper wheels complementary to an upper portion of the track;
   the carriage includes a plurality of lower wheels complementary to a lower portion of the track; and
   the upper wheels and the lower wheels rotate as the carriage travels along the track.

7. The retractable fixture of claim 6, wherein the upper portion of the track has a protrusion and each upper wheel includes a groove complementary to the protrusion.

8. The retractable fixture of claim 7, wherein:
   the wheelchair includes a battery;
   the actuator is electrically coupled to the battery;
   a switch is in communication with the actuator for causing the actuator to rotate the arm in the first and second directions;

the switch is coupled to an arm of the wheelchair; and the platform includes at least one of a storage box, a compartmentalized tray, or a generally planar surface.

9. A retractable fixture for use with a wheelchair, comprising:

a track having a forward end and a rear end;

means for mounting the track beside the wheelchair;

a carriage configured to travel along the track;

a platform rotatably coupled to the carriage at a front pivot point; and an arm rotatably coupled to the platform at a rear pivot point, the arm having a fixed pivot point;

wherein the fixed pivot point, the rear pivot point, and the front pivot point are configured such that rotation of the arm in a first direction about the fixed pivot point rotates the platform outwardly from behind the wheelchair, and rotation of the platform outwardly from behind the wheelchair forces the carriage to travel along the track toward the track forward end and the platform to move beside the wheelchair.

10. The retractable fixture of claim 9, wherein the fixed pivot point is coupled to the track.

11. The retractable fixture of claim 9, wherein the track is generally linear.

12. The retractable fixture of claim 9, wherein the means for mounting the track beside the wheelchair includes means for separating the track from the wheelchair.

13. The retractable fixture of claim 9, wherein the means for mounting the track beside the wheelchair includes a bracket configured to removably attach the track to the wheelchair.

14. The retractable fixture of claim 9, wherein the means for mounting the track includes at least one of a bracket, a weld, or a rivet.

15. The retractable fixture of claim 9, further comprising an actuator coupled to the arm to rotate the arm in the first direction about the fixed pivot point.

16. The retractable fixture of claim 15, wherein:

the wheelchair includes a battery; and the actuator is electrically coupled to the battery.

17. The retractable fixture of claim 16, further comprising a switch in communication with the actuator for causing the actuator to rotate the arm in the first and second directions, the switch being coupled to an arm of the wheelchair.

18. The retractable fixture of claim 9, wherein:

the carriage includes a wheel complementary to the track; and the wheel rotates as the carriage travels along the track.

19. The retractable fixture of claim 9, wherein:

the carriage includes a plurality of upper wheels complementary to an upper portion of the track;

the carriage includes a plurality of lower wheels complementary to a lower portion of the track; and the upper wheels and the lower wheels rotate as the carriage travels along the track.

20. The retractable fixture of claim 19, wherein the upper portion of the track has a protrusion and each upper wheel includes a groove complementary to the protrusion.

21. The retractable fixture of claim 20, wherein:

an actuator is coupled to the arm to rotate the driving arm in the first direction about the fixed pivot point;

the wheelchair includes a battery;

the actuator is electrically coupled to the battery; and the platform includes at least one of a storage box, a compartmentalized tray, or a generally planar surface.

22. The retractable fixture of claim 9, wherein the platform includes at least one of a storage box, a compartmentalized tray, or a generally planar surface.

23. A retractable fixture for use with a wheelchair, comprising:

a platform movable between a first position behind the wheelchair and a second position beside the wheelchair;

a track beside the wheelchair, the track having a forward end and a rear end;

a carriage configured to travel along the track, the carriage being rotatably coupled to the platform at a front pivot point; and an arm rotatably coupled to the platform at a rear pivot point, the arm being rotatable about a fixed pivot point;

wherein the carriage travels along the track toward the track forward end, the platform rotates about the front pivot point in a first direction, and the arm rotates about the fixed pivot point in the first direction when the platform moves from the first position to the second position; and wherein the carriage travels along the track toward the track second end, the platform rotates about the front pivot point in a second direction, and the arm rotates about the fixed pivot point in the second direction when the platform moves from the second position to the first position.

24. The retractable fixture of claim 23, further comprising means for rotating the arm about the fixed pivot point.

25. The retractable fixture of claim 23, further comprising means for moving the carriage along the track.

26. The retractable fixture of claim 23, further comprising means for mounting the track beside the wheelchair.

27. The retractable fixture of claim 23, wherein the platform includes at least one of a storage box, a compartmentalized tray, or a generally planar surface.

* * * * *